US006660637B2

(12) United States Patent
Delage et al.

(10) Patent No.: US 6,660,637 B2
(45) Date of Patent: Dec. 9, 2003

(54) PROCESS FOR CHEMICAL MECHANICAL POLISHING

(75) Inventors: Stephanie Delage, Munich (DE); Alfred Kersch, Putzbrunn (DE); Johannes Baumgartl, Riegersdorf (AT)

(73) Assignee: Infineon Technologies AG, Munich (DE)

( * ) Notice: Subject to any disclaimer, the term of this patent is extended or adjusted under 35 U.S.C. 154(b) by 63 days.

(21) Appl. No.: 09/967,318

(22) Filed: Sep. 28, 2001

(65) Prior Publication Data

US 2003/0064594 A1 Apr. 3, 2003

(51) Int. Cl.[7] ..... H01L 21/302; H01L 21/461; B24B 47/02

(52) U.S. Cl. ..... 438/692; 438/691; 451/332

(58) Field of Search ..... 438/690, 691, 438/692, 693; 451/332

(56) References Cited

U.S. PATENT DOCUMENTS 6,354,926 B1 * 3/2002 Walsh ..... 451/285
6,407,009 B1 * 6/2002 You et al. ..... 438/782
2001/0044263 A1 * 11/2001 Andideh et al. ..... 451/51
2002/0052064 A1 * 5/2002 Grabbe et al. ..... 438/113
2002/0173249 A1 * 11/2002 Dyer ..... 451/60
2003/0027424 A1 * 2/2003 Paik ..... 438/692
2003/0029841 A1 * 2/2003 Moon ..... 216/89

* cited by examiner

*Primary Examiner*—Carl Whitehead
*Assistant Examiner*—William Vesperman
(74) *Attorney, Agent, or Firm*—Fish & Richardson P.C.

(57) ABSTRACT

A chemical mechanical polishing process rotates a wafer having an alignment mark at a wafer rotation rate and a polishing surface at an off-matched rotation rate. The wafer rotation rate and the off-matched rotation rate are not equal. The wafer rotating at the wafer rotation rate and the polishing surface rotating at the off-matched rotation rate touch to polish a plurality of points on the wafer. The rotation of the wafer rotating at the wafer rotation rate is adjusted with respect to the polishing surface rotating at the off-matched rotation rate to achieve an approximately zero averaged rotation rate velocity for each of the points on the wafer with respect to the polishing surface polishing the wafer upon a completion of the total polishing time.

19 Claims, 12 Drawing Sheets

PROCESS FOR CHEMICAL MECHANICAL POLISHING

TECHNICAL FIELD

This invention relates to manufacturing semiconductors, and more particularly, to reducing asymmetric polishing of a semi-conductive wafer during off-matched chemical mechanical polishing ("CMP").

BACKGROUND

Manufacturing semiconductors involves a complex, multi-step process. One of the steps in this process includes planarizing a semi-conductive wafer in preparation for other steps, such as lithography.

Typically, manufacturing semiconductors employs chemical mechanical polishing to planarize a wafer. Chemical mechanical polishing is used because it provides a good overall planarizing performance when polishing the wafer.

CMP involves rotating a wafer and a polishing pad at select frequencies and touching the rotating wafer and pad to polish the wafer. A polishing chemical solution may also be applied to facilitate the polishing of the wafer.

One method of CMP, known as off-matched CMP, involves rotating a wafer at a first desired frequency and rotating a polishing pad at a second, unequal frequency. Despite better planarizing qualities (e.g., reducing scratches and other nonconformities on a wafer), off-matched CMP may result in an asymmetric polishing of the wafer.

SUMMARY

The invention relates to chemical mechanical polishing. In one aspect, the invention provides a process for reducing asymmetric polishing of a semi-conductive wafer in off-matched CMP. The process includes rotating a wafer having an alignment mark at a wafer rotation rate and a polishing surface at an off-matched rotation rate. For off-matched CMP, the wafer rotation rate and the off-matched rotation rate are not equal.

The wafer, rotating at the wafer rotation rate, and the polishing surface, rotating at the off-matched rotation rate, touch to polish points on the wafer. The wafer rotation rate and the off-matched rotation rate are then adjusted to achieve an approximately zero averaged rotation rate velocity for each point polished on the wafer with respect to the polishing surface, upon completion of a total polishing time.

In another aspect, the invention includes a wafer having an alignment mark rotating at a wafer rotation rate and a first polishing pad rotating at an off-matched rotation rate. A wafer carrier holds and rotates the wafer at the wafer rotation rate. Again, the wafer rotation rate and the off-matched rotation rate are not equal.

The wafer rotating at the wafer rotation rate and the first polishing pad rotating at the off-matched rotation rate touch to polish points on the wafer. The wafer and the first polishing pad touch for a portion of a total polishing time and then separate. Upon separation, the wafer rotation rate is adjusted to an adjusted wafer rotation rate and a second polishing pad is rotated at an adjusted off-matched rotation rate.

The wafer rotating at the adjusted wafer rotation rate and the second polishing pad rotating at the adjusted off-matched rotation rate touch to polish the plurality of points on the wafer. Together, the adjusted wafer rotation rate and adjusted off-match rotation rate cause an approximately zero averaged rotation rate velocity for each point on the wafer with respect to the rotation of a polishing surface. In this aspect the polishing surface is defined by the rotation of the first pad and the second pad polishing the wafer.

In yet another aspect of the invention, a CMP process for polishing a semi-conductive wafer includes rotating a wafer having an alignment mark at a wafer rotation rate and a polishing surface at an off-matched rotation rate Again, the wafer rotation rate and the off-matched rotation rate are not equal.

The wafer rotating at the wafer rotation rate and the polishing surface rotating at the off-matched rotation rate touch at an initial angle $\theta_i$ with respect to the polishing surface. The position of the wafer rotating at the wafer rotation rate is then adjusted with respect to the polishing surface in a manner to achieve an approximately zero averaged rotation rate velocity for each of the points on the wafer with respect to the polishing surface.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
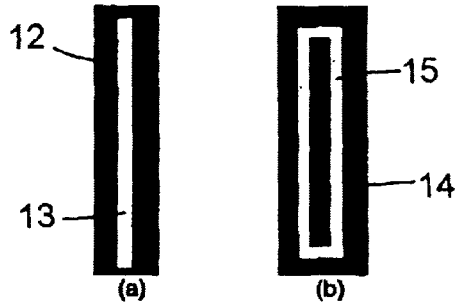
FIG. 1*a* is a top view of a standard alignment mark.
FIG. 1*b* is a top view of a double edge alignment mark.

Alignment marks, 12 or 14 (FIG. 1), are typically formed on a wafer 22 (FIG. 2) prior to CMP. Alignment marks 12 or 14 generally include depressed areas 13 and 15. Depressed areas 13 and 15 typically operate to ensure the proper alignment of wafer 22 during the manufacturing process.

Asymmetric polishing of wafer 22 during off-matched CMP may distort alignment marks 12 or 14. Any distortion in these marks may cause an inaccurate placement of wafer 22 during subsequent manufacturing steps.

The following embodiments reduce asymmetric polishing of wafer 22 during off-matched CMP. In particular, asymmetric polishing may be reduced by adjusting the relative rotation rates of wafer 22 and polishing surface 24 to achieve an approximately zero average rotation rate velocity for each point 23, 25 and 27 on wafer 22 with respect to polishing surface 24 over a total polishing time $t_p$ (i.e., a zero averaged relative velocity vector for each point 23, 25 and 27 polished on wafer 22 by polishing surface 24 ).

CMP involves touching a wafer 22 (FIG. 2) rotating at a wafer rotation rate $\omega_c$ and a polishing surface 24 rotating at a pad rotation rate $\omega_p$ to polish a plurality of points 23, 25 and 27 on wafer 22. A wafer carrier (not shown) rotates wafer 22 at wafer rotation rate $\omega_c$ and holds a surface, defined by points 23, 25 and 27 on wafer 22, to polishing surface 24.

CMP processes may be divided into two categories; matched CMP and off-matched CMP. In matched CMP, wafer 22 and polishing surface 24 rotate at the same rotation rate to polish points 23, 25 and 27. In other words, wafer rotation rate $\omega_c$ and polishing pad rotation rate $\omega_p$ are equal in magnitude as wafer 22 and polishing surface 24 touch. As a result, the average rotation rate velocity for each point (e.g., point 25) polished on wafer 22 with respect to polishing surface 24 is approximately zero.

In off-matched CMP, wafer 22 and polishing surface 24 rotate at unequal or varying rotation rates to polish wafer 22. In other words, wafer rotation rate $\omega_c$ and polishing pad rotation rate $\omega_p$, herein referred to as off-matched rotation rate $\omega_{p\text{-}off}$, are not equal in magnitude as wafer 22 and polishing surface 24 touch. As a result, the average rotation rate velocity for each point (e.g. point 25 ) polished on wafer 22 with respect to polishing surface 24 is non-zero. Heretofore, the non-zero average relative rotation rate velocity in off-matched CMP caused asymmetric polishing of wafer 22.

Figure 2:
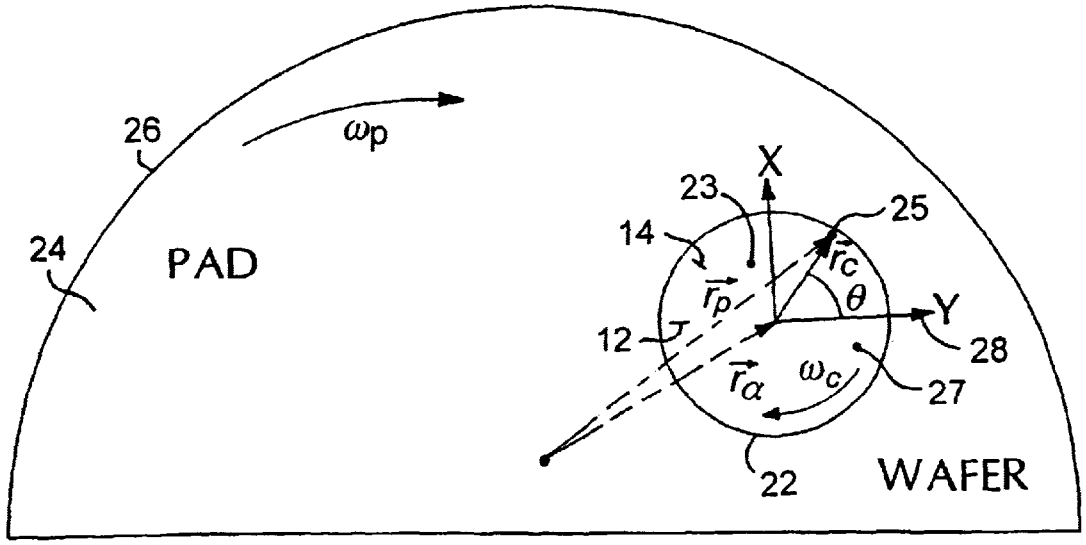
FIG. 2 defines relative rotational parameters for a wafer during CMP.

The average rotation rate velocity (i.e., the relative velocity vector) for each point polished on wafer 22 may be determined by comparing the rotation of each point 23, 25 and 27 with the rotation of polishing surface 24 on pad 26. For example, the average rotation rate velocity at point 25, here ($r_c$, $\theta$), calculated with respect to the polishing surface 24 and the coordinate system shown in FIG. 2 is:

$$\vec{v} = \vec{r}_p \times \vec{\omega}_p - \vec{r}_c \times \vec{\omega}_c = \vec{r}_{cc} \times \vec{\omega}_p + \vec{r}_c \times (\vec{\omega}_p - \vec{\omega}_c)$$

$$\Rightarrow \vec{v} = r_{cc}\omega_p \begin{vmatrix} \cos(\omega_c t) \\ \sin(\omega_c t) \end{vmatrix} + r_c \Delta\omega \begin{vmatrix} \cos(\theta) \\ \sin(\theta) \end{vmatrix}$$

wherein $$\Delta\omega = \omega_p - \omega_c$$

Figure 3A:
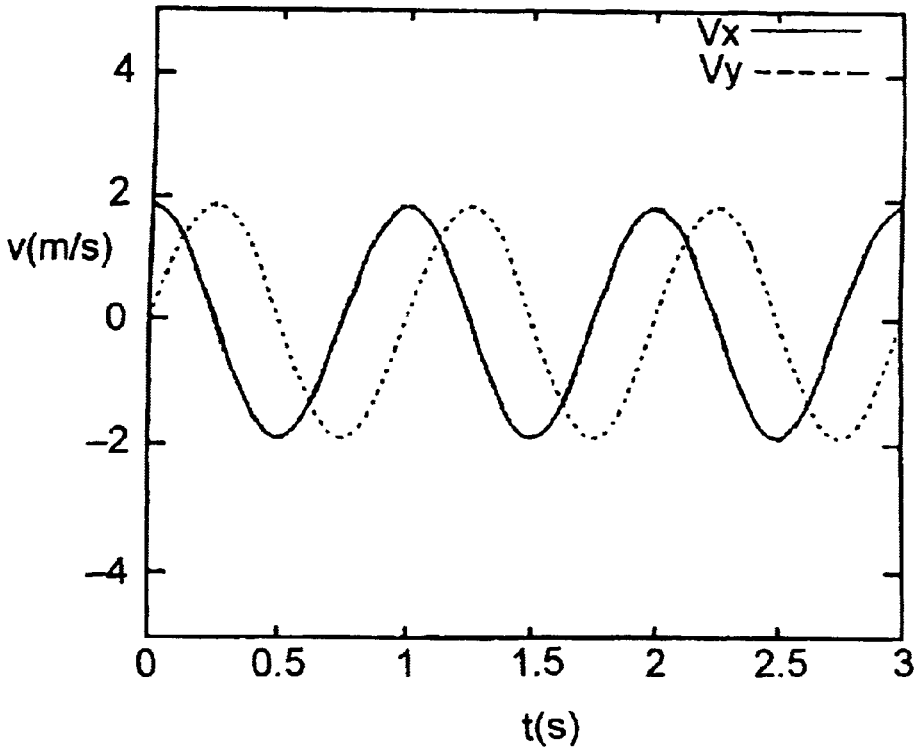
FIG. 3*a* graphs the instantaneous velocity components $V_x$ and $V_y$ for a point ($\theta$ equals 0.365Π, $r_c$ equals 0.1 m and $r_{cc}$ equals 0.3 m) on the wafer in FIG. 2 during matched CMP, where $\omega_c$ and $\omega_p$ both equal 100 revolutions per minute ("rpm").
Figure 3B:
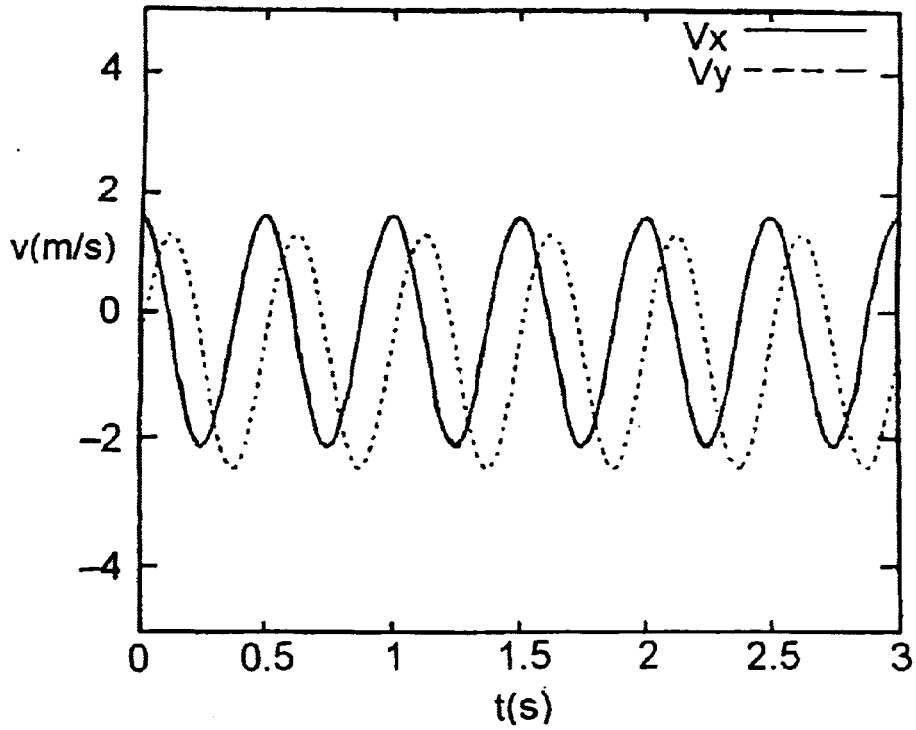
FIG. 3*b* graphs the instantaneous velocity components $V_x$ and $V_y$ for a point ($\theta$ equals 0.365Π, $r_c$ equals 0.1 m and $r_{cc}$ equals 0.3 m) on the wafer in FIG. 2 during off-matched CMP, where $\omega_c$ equals 120 rpm and $\omega_{p\text{-}off}$ equals 60 rpm.

FIGS. 3*a* and 3*b* graph the instantaneous X and Y velocity components of point 25 at $\theta$=0.365Π, $r_c$=0.1 m and $r_{cc}$=0.3 m on wafer 22 as polishing surface 24 and wafer 22 touch. The instantaneous X and Y velocity components $V_x$ and $V_y$ are graphed as functions of velocity, in meters per second, over time in seconds based on the movement of point 25 though Cartesian coordinate system 28 (FIG. 2).

FIG. 3*a* shows $V_x$ and $V_y$ for matched CMP, where wafer 22 and polishing surface 24 rotate at the same frequencies but in opposite directions to polish wafer 22 (e.g., $\omega_c$ and $\omega_p$ both equal at 100 rpm). Over each complete rotation of wafer 22 and polishing surface 24, the average rotational rate velocity of point 25 in the X and Y direction is zero. This zero average rotation rate velocity causes point 25 to be symmetrically polished.

FIG. 3*b* shows $V_x$ and $V_y$ for off-matched CMP, where wafer 22 and polishing surface 24 rotate at unequal rotation rates to polish wafer 22 (e.g., $\omega_c$ equals 120 rpm and $\omega_{p\text{-}off}$ equals 60 rpm). Over each complete rotation of wafer 22, the average rotational velocity of point 25 in the X and Y direction with respect to polishing surface 24 is non-zero. Hence, off-matched CMP causes point 25 to be polished asymmetrically.

Figure 4A:
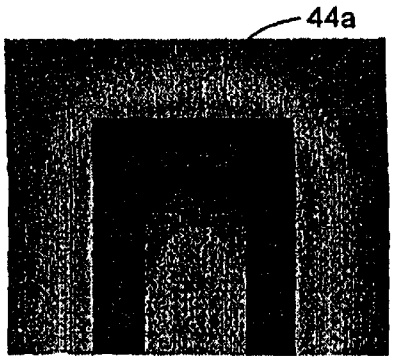
FIG. 4*a* shows an alignment mark's topography after 100 seconds of symmetric polishing.
Figure 4B:
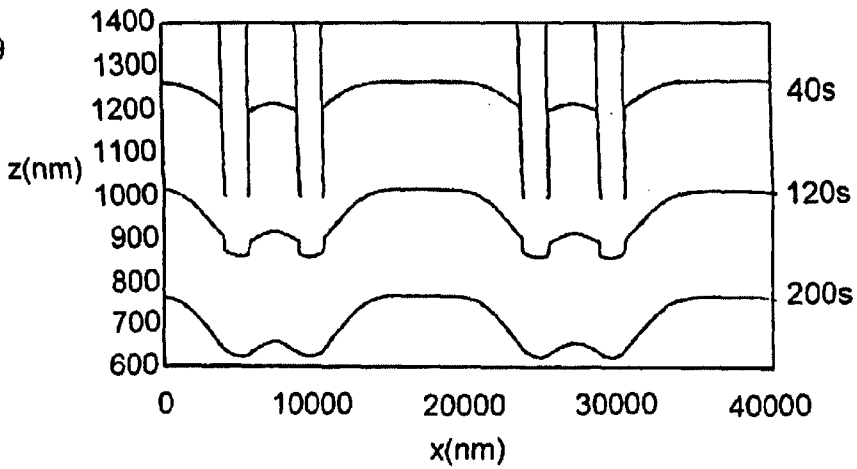
FIG. 4*b* shows the profile evolution of the alignment mark in FIG. 4*a* over periods of time.

FIGS. 4*a* and 4*b* show the result of symmetric polishing on alignment mark 44*a*. In particular, FIG. 4*a* shows little or no distortion in the topography of mark 44*a* after 100 seconds of symmetric polishing. FIG. 4*b* shows the little or no distortion in the profile of mark 44*a* after 40 seconds, 120 seconds and 200 seconds of symmetric polishing.

Figure 4C:
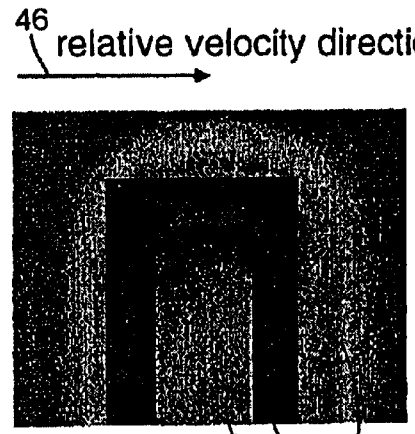
FIG. 4*c* shows an alignment mark's topography after 100 seconds of asymmetric polishing.
Figure 4D:
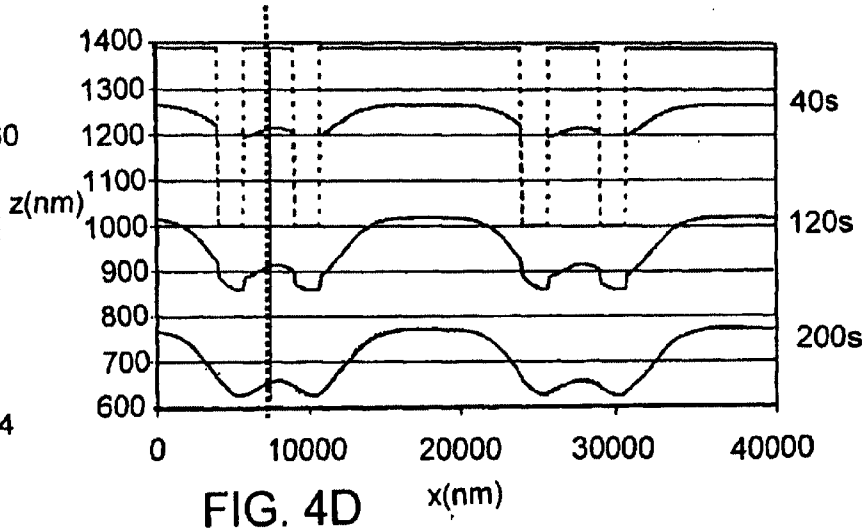
FIG. 4*d* shows the profile evolution of the alignment mark in FIG. 4*c* over periods of time.

FIGS. 4*c* and 4*d*, on the other hand, show the result of asymmetric polishing on alignment mark 44*c*. In particular, FIG. 4*c* shows a shift 45 in the topography of mark 44*c* in a dominant direction of the average velocity vector 46 after 100 seconds of asymmetric polishing. FIG. 4*d* shows an uneven, distorted profile of mark 44*c* after 40 seconds, 120 seconds and 200 seconds of asymmetric polishing.

Ensuring that the average rotation rate velocity of each point 23, 25 and 27 polished on wafer 22 is approximately zero with respect to polishing surface 24 reduces asymmetric polishing during off-matched CMP. The average rotation rate velocity for each point polished on wafer 22 may be determined as an X-component and Y-component with respect to polishing surface 24 based on the Cartesian coordinate system 28 (FIG. 2). The average rotational rate velocities in the X and Y-directions equal zero when:

$$\bar{v}_x = \frac{\sum_t (v_{x1} + v_{x2})}{t_p} = 0$$

$$\bar{v}_y = \frac{\sum_t (v_{y1} + v_{y2})}{t_p} = 0$$

Thus, asymmetric polishing of wafer 22 may be reduced during off-matched CMP by achieving an average rotation rate velocity for both X and Y directions (i.e., $\bar{v}_x$ and $\bar{v}_y$) of approximately zero for every point polished on wafer 22.

Figure 5:
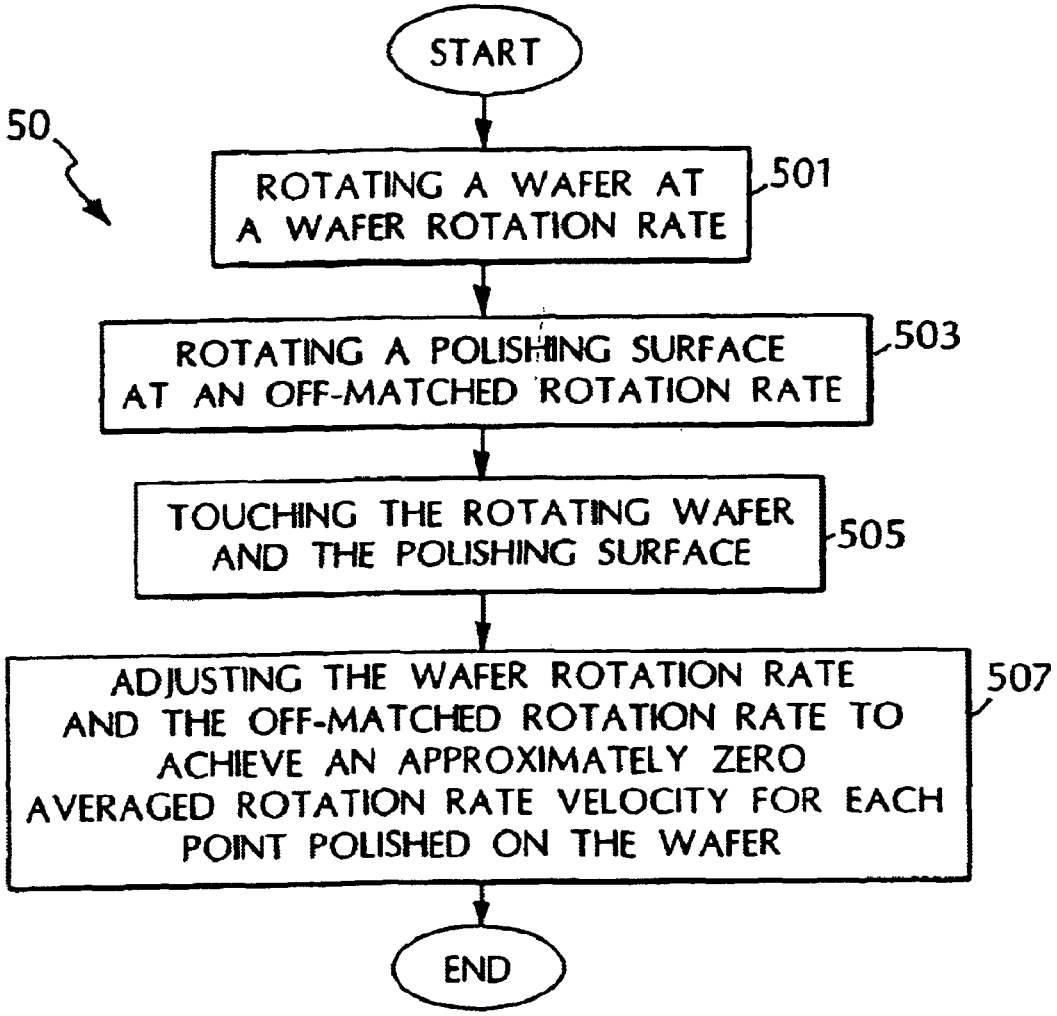
FIG. 5 is a process 50 according to one embodiment of the invention.

FIG. 5 shows a process 50 to reduce asymmetric polishing of wafer 22 during off-matched CMP. In particular, process 50 rotates (501) a wafer 22 having an alignment mark (e.g., 12 or 14) at a wafer rotation rate $\omega_c$ and rotates (503) a polishing surface 24 at an off-matched rotation rate $\omega_{p\text{-}off}$. As explained above, wafer rate $\omega_c$ and off-matched rotation rate $\omega_{p\text{-}off}$ are not equal in magnitude for off-matched CMP.

Process 50 touches (505) wafer 22 rotating at wafer rotation rate $\omega_c$ and polishing surface 24 rotating at off-matched rotation rate $\omega_{p\text{-}off}$ to polish points 23, 25, and 27. Process 50 touches (505) wafer 22 rotating at $\omega_c$ and polishing surface 24 rotating at $\omega_{p\text{-}off}$ for a portion of a total polishing time $t_p$.

Upon completion of the portion of total polishing time $t_p$, process 50 adjusts (507) the wafer rotation rate $\omega_c$ of wafer 22 and the off-matched rotation rate $\omega_{p\text{-}off}$ of the polishing surface 24. Process 50 adjusts (507) the rotation rates $\omega_c$ and $\omega_{p\text{-}off}$ to achieve an approximately zero averaged rotation rate velocity for each point 23, 25 and 27 polished on wafer 22 with respect to polishing surface 24 upon completion of the total polishing time $t_p$. Here, the total polishing time $t_p$ equals the amount of time needed to achieve a satisfactory polish of wafer 22. Process 50 may adjust (507) the wafer rotation rate $\omega_c$ and off-matched rotation rate $\omega_{p\text{-}off}$ in any manner, including for example changing the frequency, direction and/or angle θ (FIG. 10) of wafer 22 with respect to polishing surface 24 to achieve an average relative rotation rate velocity for each polished point of approximately zero upon completion of a total polishing time $t_p$.

For example, process 50 may simultaneously reverse the rotation of wafer 22 and polishing pad 24 in a continuous motion.

In another embodiment process 50 may separate wafer 22 and polishing surface 24 to adjust the wafer rotation rate $\omega_c$ and the off-matched rotation rate $\omega_{p\text{-}off}$ upon completion of the portion of the total polishing time and then touch wafer 22 and surface 24 rotating at adjusted rates to continue polishing of points 23, 25 and 27. In both such embodiments, the average polishing time at the original (501 and 503) and adjusted (507) rotations may be approximately equal. In still other embodiments, several separations of wafer 22 and surface 24 may occur to adjust (507) the wafer and off-matched rotation rates to achieve the approximately zero averaged rotation rate velocity for each point 23, 25 and 27.

FIGS. 6*a*–6*d* show relative instantaneous and average velocity information for one embodiment of the invention in which wafer 22 rotates in the same direction (e.g., clockwise) as polishing surface 24, but at different rates, to polish points 23, 25 ands 27. In particular, FIGS. 6*a–d* show that the average rotation rate velocity of wafer 22 with respect to polishing surface 24 will be zero for each point on wafer 22 touched by polishing surface 24 provided wafer 22 and polishing surface 24 rotate (501 and 503) in the same direction (e.g., clockwise) for approximately half of a total polishing time at wafer rotation rate $\omega_c$ and off-matched rotation rate $\omega_{p\text{-}off}$ and for the remainder of the total polishing time at an adjusted (507) wafer rotation $\omega_c$ and off-matched rate $\omega_{p\text{-}off}$, rotating at their previous frequency but in the reverse direction (i.e. counterclockwise).

Figure 6A:
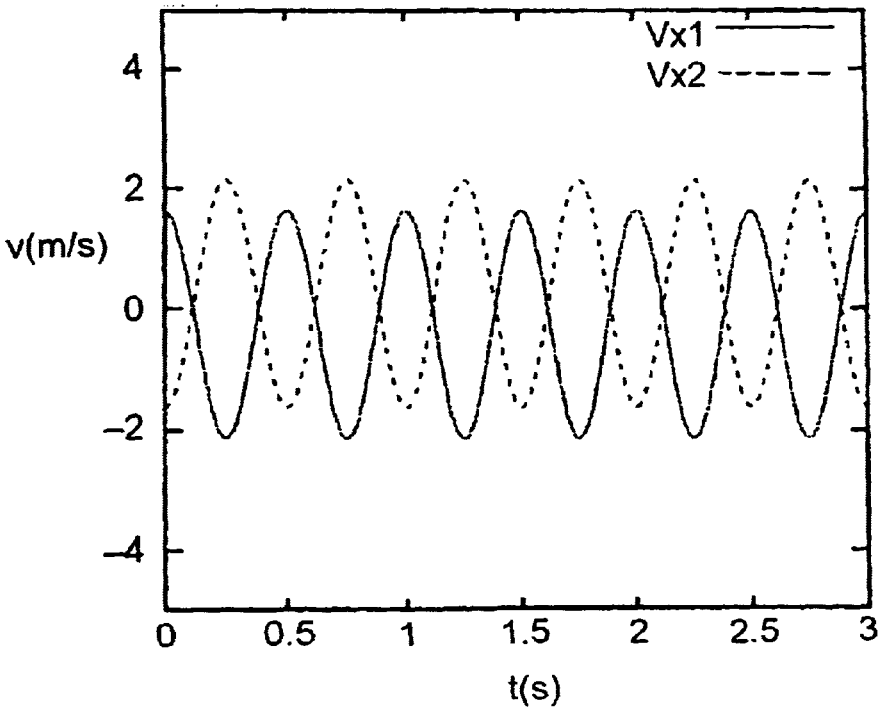
FIG. 6*a* graphs the instantaneous velocity components $V_{x1}$ and $V_{x2}$ for a point ($\theta$ equals 0.365Π, $r_c$ equals 0.1 m and $r_{cc}$ equals 0.3 m) on the wafer in FIG. 2, where the wafer and polishing surface rotate in the same direction at $\omega_c$ equals 120 rpm and $\omega_{p\text{-}off}$ equals 60 rpm.
Figure 6B:
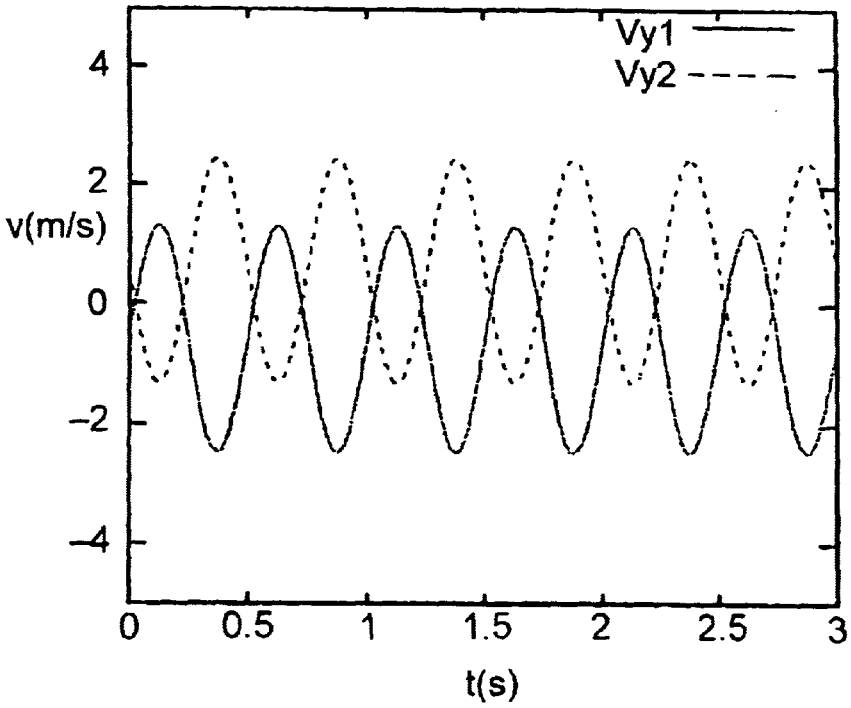
FIG. 6*b* graphs the instantaneous velocity components $V_{y1}$ and $V_{y2}$ for the point in FIG. 6*a*.

FIGS. 6*a* and 6*b* graph the instantaneous X and Y velocity components of point 25 at θ=0.365Π, $r_c$=0.1 m and $r_{cc}$=0.3 m on wafer 22 as polishing surface 24 and wafer 22 touch. In particular, $V_{x1}$, $V_{x2}$, $V_{y1}$ and $V_{y2}$ are graphed as functions of velocity, in meters per second, over time in seconds based on the movements of point 25 though Cartesian coordinate system 28, in FIG. 2.

FIG. 6*a* shows $V_{x1}$, the relative instantaneous velocity of point 25 in the X-direction for an original (501 and 503) wafer rotation rate (e.g., $\omega_c$ equals 120 rpm) and an off-matched rotation rate (e.g., $\omega_{p\text{-}off}$ equal 60 rpm) rotating in the same direction (e.g. clockwise) will be negated by $V_{x2}$. Here, $V_{x2}$ is the instantaneous relative velocity of point 25 in the X-direction at an adjusted (507) wafer rotation rate (i.e., $\omega_c$ equals 120 rpm) and an off-matched rotation rate (i.e., $\omega_{p\text{-}off}$ equals 60 rpm) rotating in the reverse direction (i.e. counterclockwise) over an equal time period, here t(s). Hence, by combining $V_{x1}$ and $V_{x2}$ process 50 achieves a zero average velocity in the X direction over total polishing time $t_p$, here six seconds, or 2t(s).

FIG. 6*b* shows the same instantaneous velocity information as FIG. 6*a* for the Y-direction in the above example. Similarly, $V_{y1}$ and $V_{y2}$ also achieve a zero average velocity in the Y direction over the total polishing time $t_p$. Thus, symmetric off-matched CMP of wafer 22 may be achieved for wafer 22 and polishing surface 24 rotating at different frequencies but in the same direction.

Figure 6D:
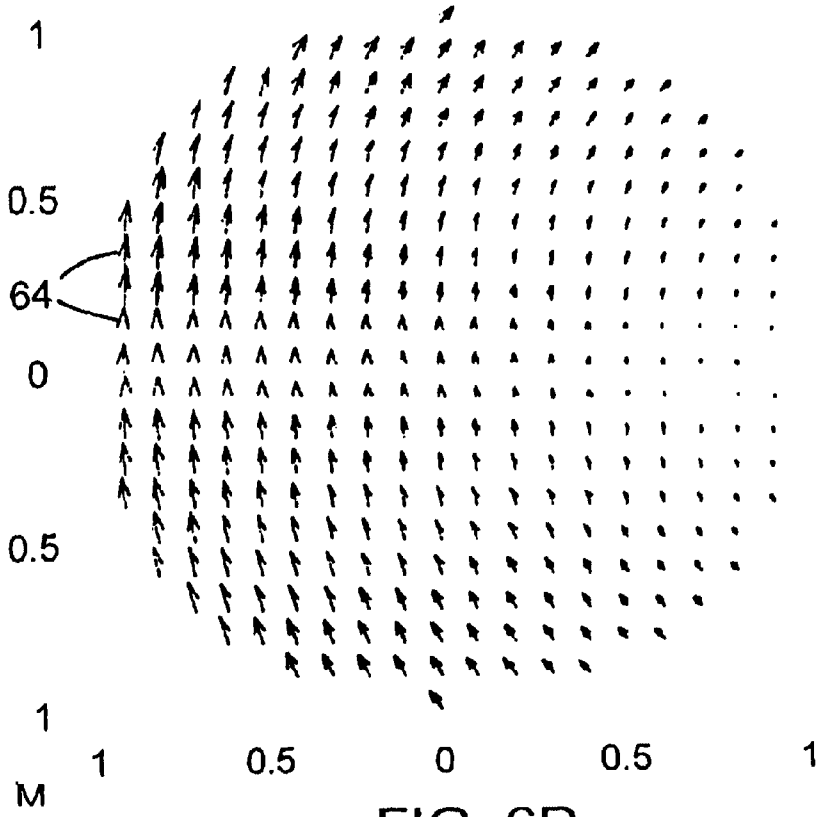
FIG. 6*d* graphs the average velocity vectors for points on the wafer in FIG. 2, at adjusted wafer and off-matched rotation rates to the rotations in FIG. 6*c*.
Figure 6C:
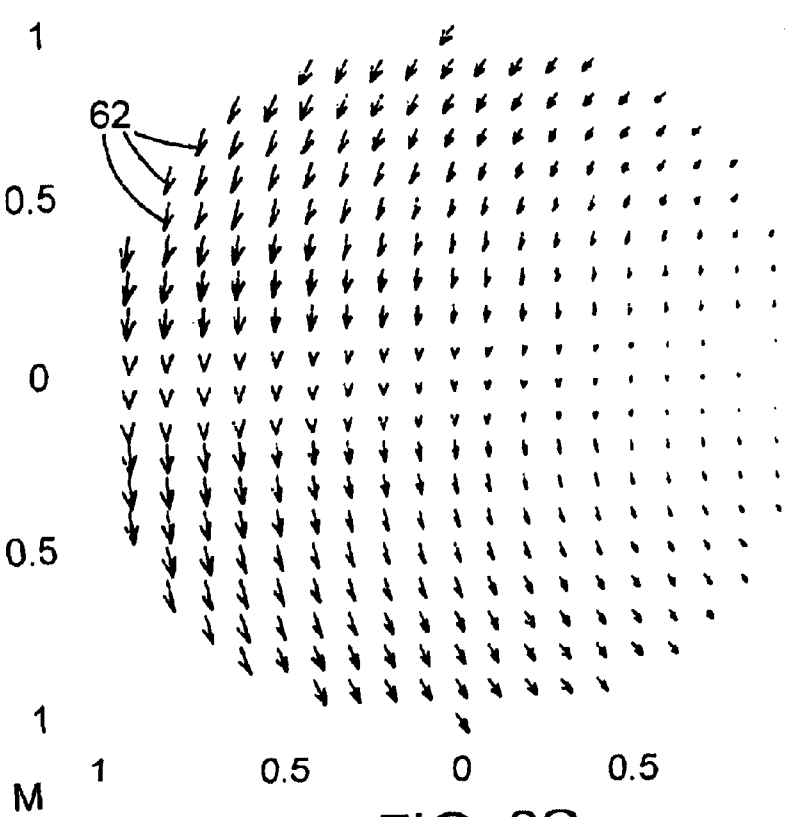
FIG. 6*c* graphs the average velocity vectors for points on the wafer in FIG. 2, where the wafer and polishing surface rotate in the same direction at $\omega_c$ equals 120 rpm and $\omega_{p\text{-}off}$ equals 60 rpm.

FIGS. 6*c* and 6*d* provide average velocity vector maps for wafer 22 with respect to polishing surface 24. In particular, each arrow 62 in FIG. 6*c* represents the average velocity vector for that point on wafer 22 during the portion t(s) of the total polishing time at the original (501 and 503) wafer rotation rate and off-matched rotation rate (e.g., $\omega_c$ equals 120 rpm and $\omega_{p\text{-}off}$ equals 60 rpm), both rotating in the clockwise direction. Likewise, each arrow 64 in FIG. 6*d* represents the same information for that point on wafer 22 for the remainder t(s) of the total polishing time at the adjusted (507) wafer rotation rates and the adjusted off-matched rotation rate (i.e., $\omega_c$ equals 120 rpm and $\omega_{p\text{-}off}$ equals 60 rmp), both rotating in the counterclockwise direction. Adding each relative velocity vector 62 and 64 together on FIGS. 6*c* and 6*d* shows that a zero average relative velocity vector (i.e., a zero relative average velocity rate) may be achieved for each point on wafer 22 by reversing the direction of both wafer 22 and surface 24 after approximately half of a total polishing time, here t(s).

FIGS. 7*a*–7*d* show the same relative instantaneous and average velocity information as FIGS. 6*a–d* but for another embodiment of the invention. In particular, FIGS. 7*a–d* show that the average rotation rate velocity of wafer 22 with respect to polishing surface 24 will be zero for each point 23, 25 and 27 on wafer 22 touched by polishing surface 24, provided wafer 22 and polishing surface 24 rotate (501 and 503) in opposite directions (e.g., wafer 22 rotates clockwise when polishing surface 24 rotates counterclockwise) for approximately half of a total polishing time at wafer rotation rate $\omega_c$ and off-matched rotation rate $\omega_{p\text{-}off}$ and for a remainder of the total polishing time at an adjusted (507) wafer rotation $\omega_c$ and off-matched rate $\omega_{p\text{-}off}$ rotating at their previous frequency but in reverse directions (i.e. wafer 22 rotates counterclockwise and polishing surface 24 rotates clockwise).

Figure 7A:
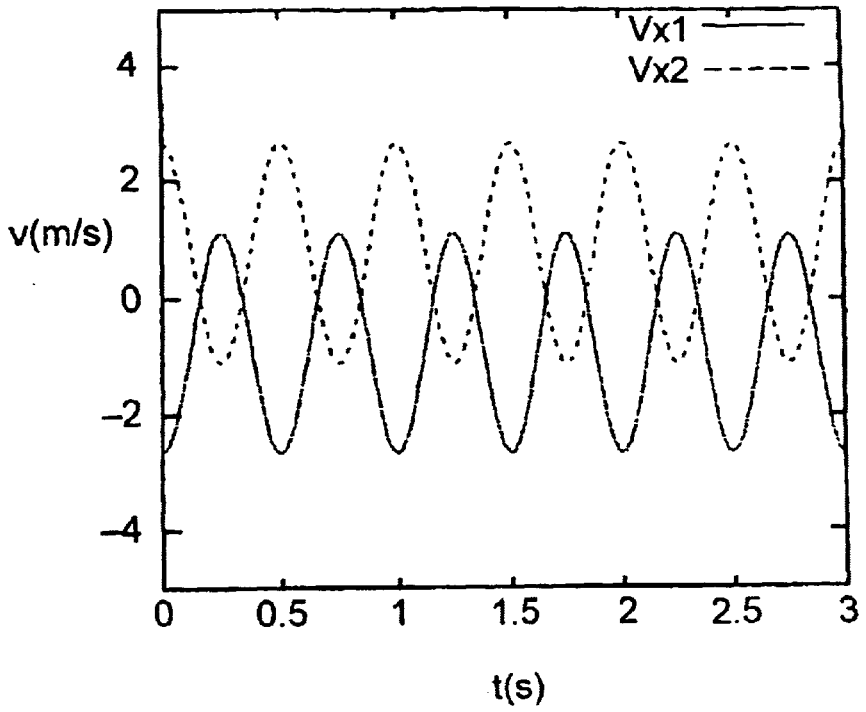
FIG. 7*a* graphs the instantaneous velocity components $V_{x1}$ and $V_{x2}$ for a point ($\theta$ equals 0.365Π, $r_c$ equals 0.1 m and $r_{cc}$ equals 0.3 m) on the wafer in FIG. 2, where the wafer and polishing surface rotate in opposite directions at $\omega_c$ equals 120 rpm and $\omega_{p\text{-}off}$ equals 60 rpm.
Figure 7B:
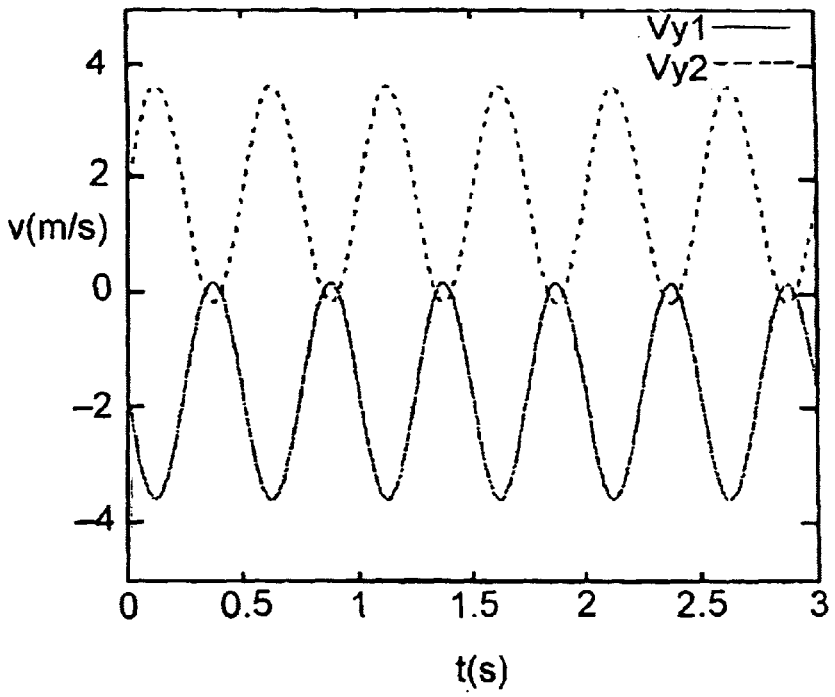
FIG. 7*b* graphs the instantaneous velocity components $V_{y1}$ and $V_{y2}$ for the point in FIG. 7*a*.

FIGS. 7*a* and 7*b* graph the instantaneous X and Y velocity components of point 25 at $\theta$=0.365Π, $r_c$=0.1 m and $r_{cc}$=0.3 m on wafer 22 as polishing surface 24 and wafer 22 touch. In particular, $V_{x1}$, $V_{x2}$, $V_{y1}$ and $V_{y2}$ are graphed as functions of velocity, in meters per second, over time in seconds based on the movements of point 25 though Cartesian coordinate system 28, in FIG. 2.

FIG. 7*a* shows $V_{x1}$, the relative instantaneous velocity of point 25 in the X-direction for an original (501 and 503) wafer rotation rate (e.g., $\omega_c$ equals 120 rpm) and an off-matched rotation rate (e.g., $\omega_{p\text{-}off}$ equal 60 rpm) rotating in opposite directions (e.g. clockwise for wafer 22 and counterclockwise for polishing surface 24) will be negated by $Vx_2$. Here, $V_{x2}$ is the instantaneous relative velocity of point 25 in the X-direction at an adjusted (507) wafer rotation rate and an off-matched rotation rate rotating at their previous frequencies (i.e., $\omega_c$ equals 120 rpm and $\omega_{p\text{-}off}$ equals 60 rpm), but in reverse directions (i.e., counterclockwise for wafer 22 and clockwise for polishing surface 24) over an equal time period, here t(s). Thus, by combining $V_{x1}$ and $V_{x2}$ process 50 achieves a zero average velocity in the X-direction for point 25 with respect to polishing surface 24 over the total polishing time $t_p$, here six seconds, or 2t (s).

FIG. 7*b* shows the same instantaneous velocity information as FIG. 7*a* for the Y-direction in the above example. Similarly, $V_{y1}$ and $V_{y2}$ also achieve a zero average velocity in the Y-direction for point 25 with respect to polishing surface 24 over the same total polishing time $t_p$. Thus, symmetric off-matched CMP of wafer 22 may be achieved for wafer 22 and polishing surface 24 rotating at different frequencies and in opposite directions.

Figures 7C, 7D:
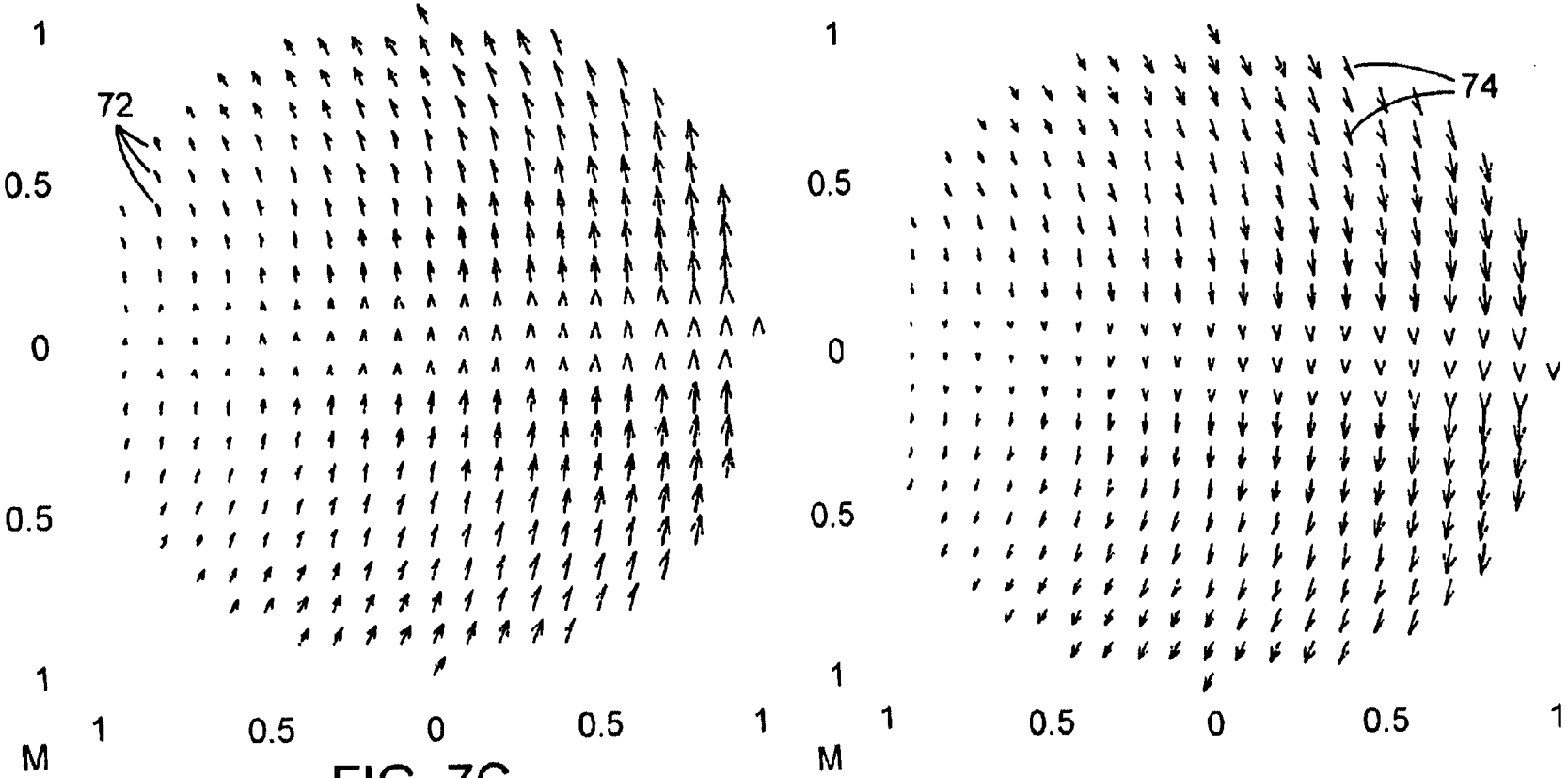
FIG. 7*c* graphs the average velocity vectors for points on the wafer in FIG. 2, where the wafer and polishing surface rotate in opposite directions at $\omega_c$ equals 120 rpm and $\omega_{p\text{-}off}$ equals 60 rpm.
FIG. 7*d* graphs the average velocity vectors for points on the wafer in FIG. 2, at adjusted wafer and off-matched rotation rates to the rotations in FIG. 7*c*.

FIGS. 7*c* and 7*d* provide average velocity vector maps for wafer 22 with respect to polishing surface 24. In particular, each arrow 72 in FIG. 7*c* represents the average velocity vector for that point on wafer 22 during the portion of the total polishing time at the original (501 and 503) wafer rotation rate and off-matched rotation rate (e.g., $\omega_c$ equals 120 rpm in the clockwise direction and $\omega_{p\text{-}off}$ equals 60 rpm in the counterclockwise direction), both rotating in opposite directions. Likewise, each arrow 74 in FIG. 7*d* represents the same information for that point on wafer 22 for the remainder of the total polishing time at the adjusted (507) wafer rotation rate and the adjusted (507) off-matched rotation rate (i.e., $\omega_c$ equals 120 rpm in the counterclockwise direction and $\omega_{p\text{-}off}$ equals 60 rmp in the clockwise direction), both rotating at their previous frequency but in opposite directions. Adding the relative velocity vectors 72 and 74 together FIGS. 7*c* and 7*d* shows that a zero average relative velocity vector (i.e., a zero average rotation rate velocity) may be achieved for each point on wafer 22 by reversing the direction of both wafer 22 and surface 24 after approximately half of a total polishing time, here t(s).

Figure 8:
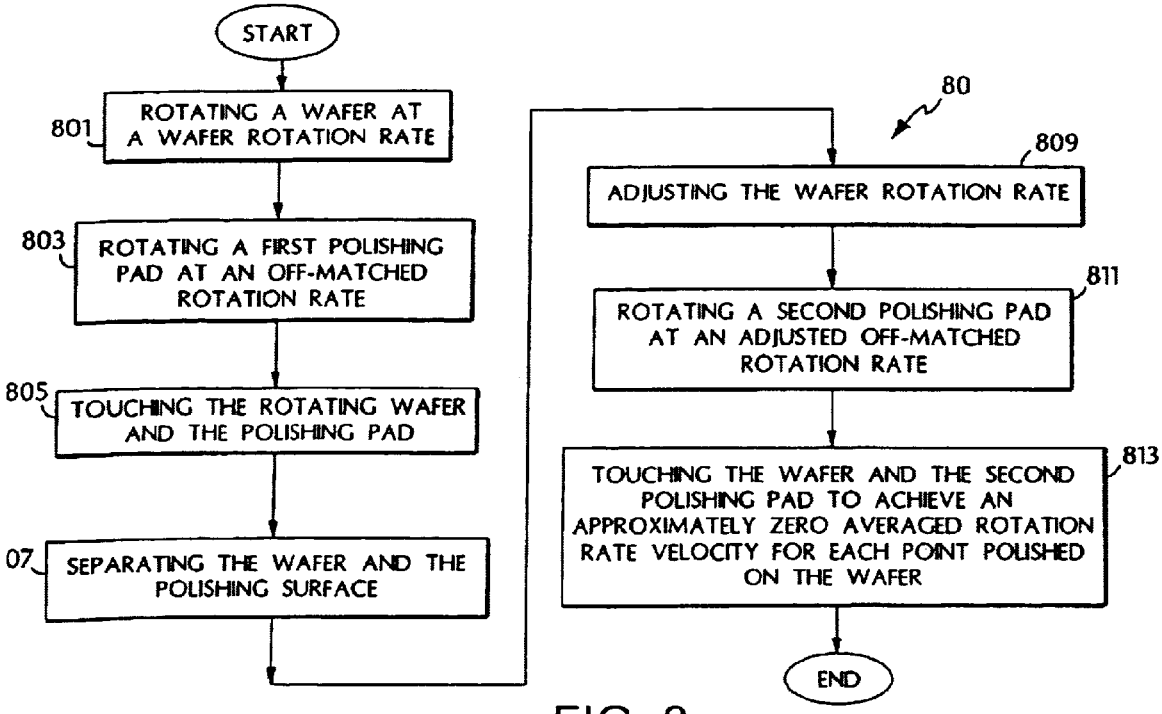
FIG. 8 is a process 80 according to one embodiment of the invention.

FIG. 8 shows an alternate embodiment process 80 to reduce asymmetric polishing of wafer 22 during off-matched CMP. In particular, process 80 rotates (801) a wafer 22 having an alignment mark (e.g., 12 or 14) at a wafer rotation rate $\omega_c$ and rotates (803) a polishing surface 24 at an off-matched rotation rate $\omega_{p\text{-}off}$.

Process 80 touches (805) wafer 22 rotating at wafer rotation rate $\omega_c$ and polishing surface 24 rotating at off-matched rotation rate $\omega_{p\text{-}off}$ to polish points 23, 25, and 27. Process 80 touches (805) wafer 22 rotating at $\omega_c$ and polishing surface 24 rotating at $\omega_{p\text{-}off}$ for a portion of a total polishing time.

Upon completion of the portion of the total polishing time, process 80 separates (807) wafer 22 and polishing surface 24 and adjusts (809) the wafer rotation rate $\omega_c$. Process 80 also rotates (811) a second polishing pad at an adjusted off-matched rotation rate $\omega_{p\text{-}off}$. Process 80 touches (813) wafer 22 rotating at the adjusted (809) wafer rotation rate $\omega_c$ and the second polishing pad rotating at adjusted (811) off-matched rotation rate $\omega_{p\text{-}off}$ to polish the points 23, 25 and 27 on wafer 22 and achieve an approximately zero averaged rotation rate velocity for each point 23, 25 and 27 on wafer 22 with respect to polishing surface 24 upon completion of the total polishing time $t_p$.

Figure 9:
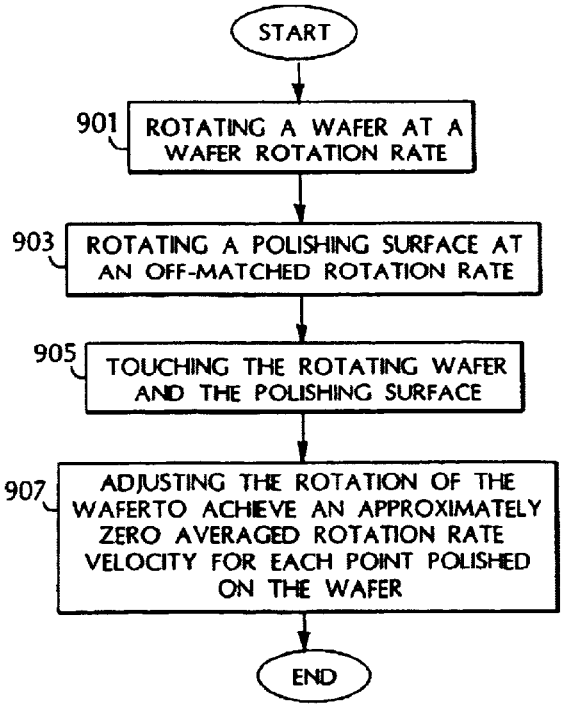
FIG. 9 is a process 90 according to one embodiment of the invention.

FIG. 9 shows an alternative embodiment process 90 to reduce asymmetric polishing of wafer 22 during off-matched CMP. In particular, process 90 rotates (901) a wafer 22 having an alignment mark (e.g. 12 or 14) at a wafer rotation rate $\omega_c$ and rotates (903) a polishing surface 24 at an off-matched rotation rate $\omega_{p\text{-}off}$.

Process 90 touches (905) wafer 22 rotating at wafer rotation rate $\omega_c$ and polishing surface 24 rotating at off-matched rotation rate $\omega_{p\text{-}off}$ at an initial angle $\theta_i$ (FIG. 10) with respect to polishing surface 24 to polish points 23, 25, and 27. Process 90 touches (905) wafer 22 rotating at $\omega_c$ and polishing surface 24 rotating at $\omega_{p\text{-}off}$ for a portion of a total polishing time.

Upon completion of the portion of the total polishing time, process 90 adjusts (907) the rotation of wafer 22 rotating at wafer rotation rates $\omega_c$ with respect to polishing surface 24 rotating at off-matched rotation rate $\omega_{p\text{-}off}$. Process 90 adjusts (907) to achieve an approximately zero average rotation rate velocity for each point 23, 25 and 27 polished on wafer 22 with respect to polishing surface 24 upon completion of a total polishing time $t_p$.

Process 90 may adjust (907) the rotation of wafer 22 in any manner to achieve a zero average rotation rate velocity in both the X and Y-directions upon completion of total polishing time $t_p$. For example, process 90 may divide the total polishing time $t_p$ into a plurality of periods p and separate wafer 22 and polishing surface 24 upon completion of each of period p to adjust the position of wafer 22 with respect to polishing surface 24 by an adjustment angle $\theta_a$. Adjustment angle $\theta_a$ (i.e., the relative angular position of wafer 22 with respect to polishing surface 24 from initial angle $\theta_i$) may be computed from a point 25 ($r_c$, $\theta_i$) on wafer 22 based on the number of periods p, provided all of the periods are apportioned equally, as follows:

$$\theta_a=\theta_i+2\Pi/p$$

where p is the number of equally divided periods.

After adjusting (907) the position of wafer 22 by adjustment angle $\theta_a$, the adjusted wafer 22 and polishing surface 24 touch for the equally apportioned period of the total polishing time. Upon completions of all of the periods, and hence the total time period $t_p$, the average rotation rate for each point polished on wafer 25 will be approximately zero with respect to polishing surface 24.

Figure 10:
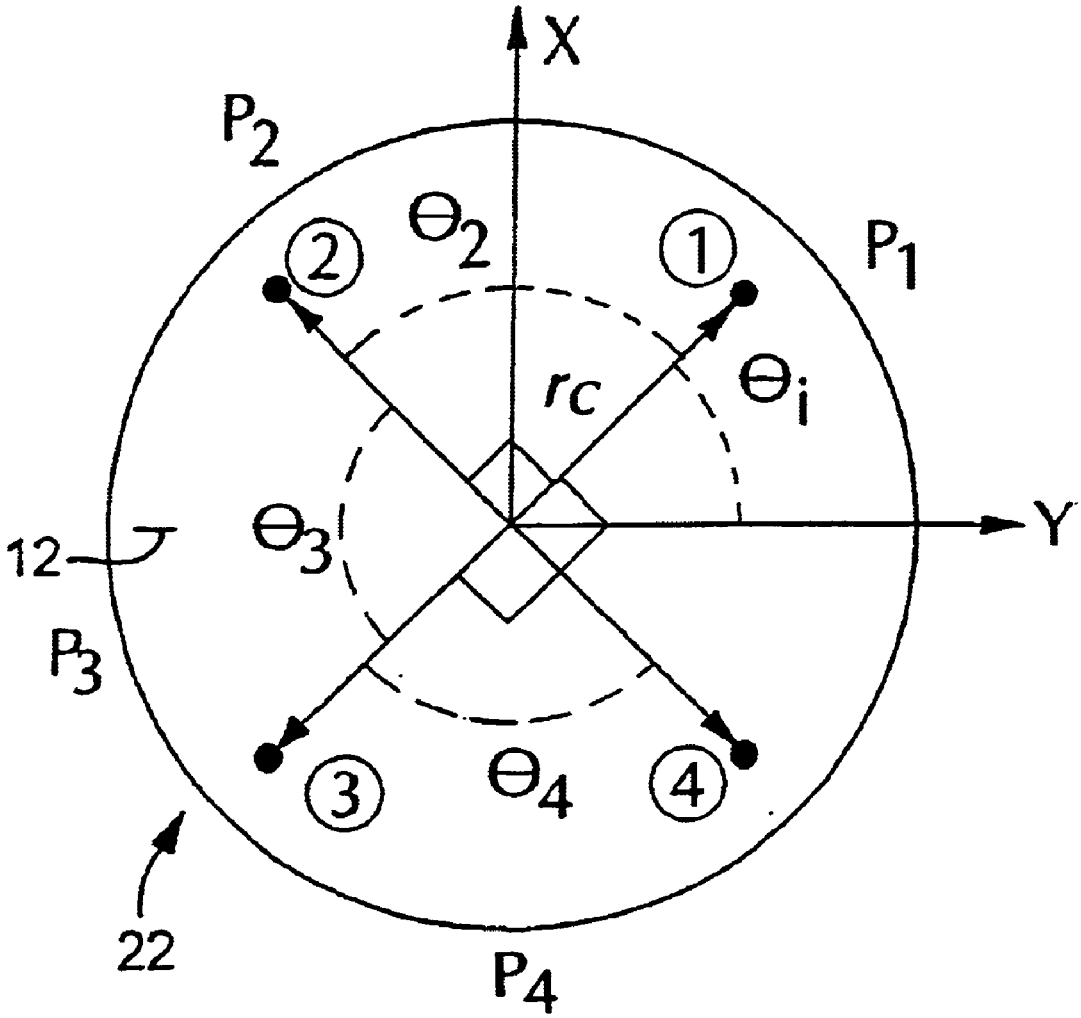
FIG. 10 is a top view of a wafer showing initial angle $\theta_1$ and adjustment angles $\theta_2$, $\theta_3$ and $\theta_4$.

FIG. 10 shows wafer 22 polished by process 90 in the manner as described above. Here, a total time period $t_p$ is divided into four portions of equal time periods $p_1$, $p_2$ $p_3$ and $p_4$. Thus, the adjustment angle $\theta_a$ is $\theta_i$+Π/2 for period $p_2$, $\theta_1$+Π for period $p_3$, and $\theta_i$+3Π/4 for period $p_4$.

FIGS. 11*a*–11*d* graph the instantaneous X and Y velocity components of point 25 at $\theta_i$=0.365Π, $r_c$=0.1 m and $r_{cc}$=0.3 m for the positions 1 ($r_c$, $\theta_i$), 2 ($r_c$, $\theta_2$ equals $\theta_{i+\Pi/2}$) 3 ($r_c$, $\theta_3$ equals $\theta_{i+\Pi}$) and 4 ($r_c$, $\theta_4$ equals $\theta_{i+3\Pi/4}$) on wafer 22 (FIG. 10) as polishing surface 24 and wafer 22 touch. The X and Y velocity components $V_{x1-4}$ and $V_{y1-4}$ are graphed as instantaneous functions of velocity, in meters per second, over time in seconds based on the movement of point 25 though Cartesian coordinate system 28 (FIG. 2).

Figure 11A:
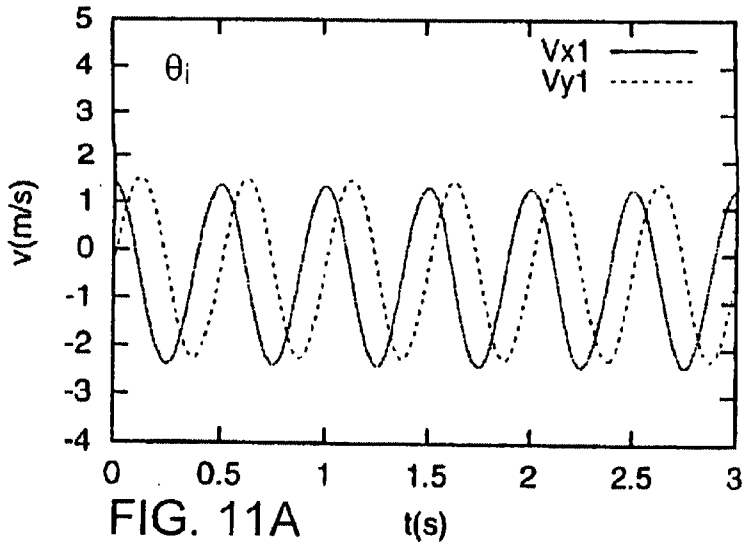
FIG. 11 graphs the instantaneous velocity components $V_{x1\text{-}4}$ and $V_{y1\text{-}4}$ for a point ($\theta_1$ equals 0.365Π, $r_c$ equals 0.1 m and $r_{cc}$ equals 0.3 m) on the wafer in FIG. 2 according the adjustment angles in FIG. 10, where $\omega_c$ equals 120 rpm and $\omega_{p\text{-}off}$ equal 60 rpm.

FIG. 11*a* graphs instantaneous velocity $V_{x1}$ and $V_{y1}$ for point 25 in process 90, where wafer 22 and polishing surface 24 rotates at wafer and off-matched rotation rates to polish wafer 22 (e.g., $\omega_c$ equals 120 rpm and $\omega_{p\text{-}off}$ equals 60 rpm). Here, the instantaneous velocity $V_{x1}$ and $V_{y1}$ graph point 25 on wafer 22 which first touches polishing surface 24 at an initial angle $\theta_i$ with respect Cartesian coordinate system 28.

Figure 11B:
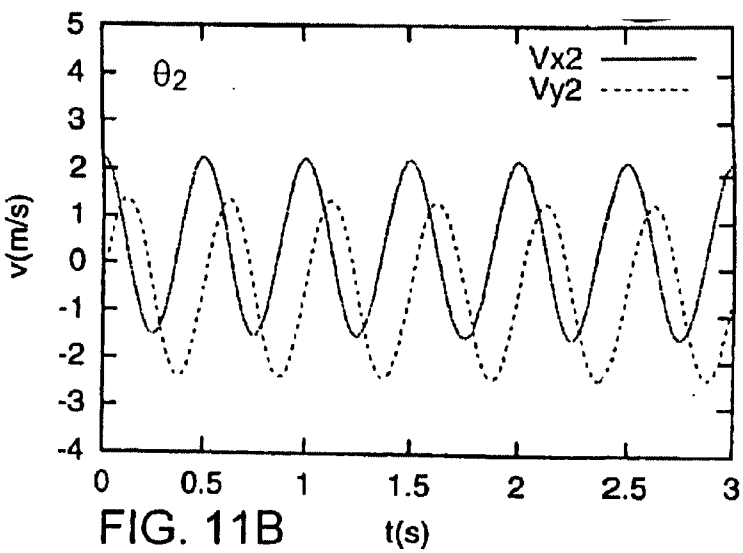
Figure 11C:
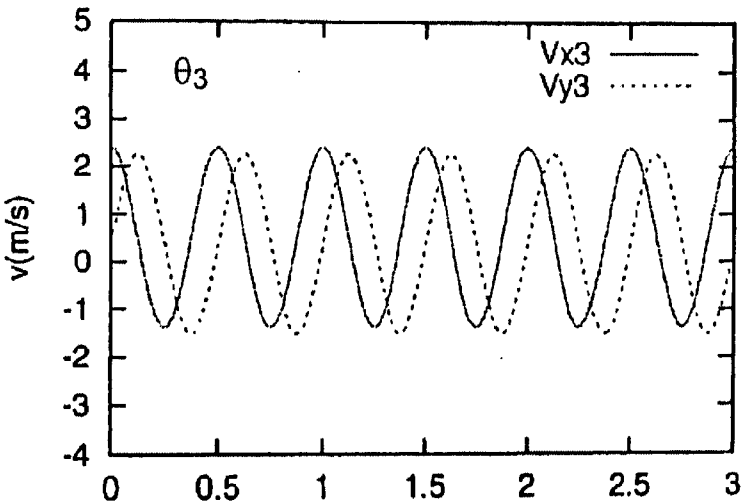
Figure 11D:
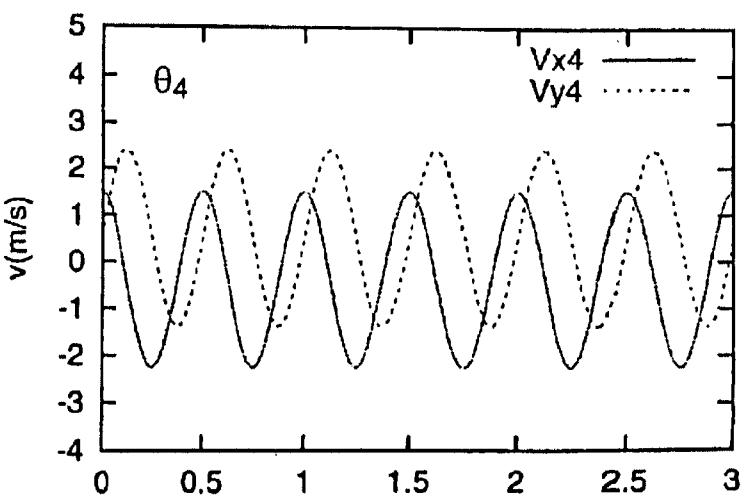

FIGS. 11*b–d* graph the instantaneous velocity $V_{x1-4}$ and $V_{y2-4}$ for point 25 adjusted by its proper adjustment angles (e.g., $\theta_2$ equals $\theta_{i+\Pi/2}$, $\theta_3$ equals $\theta_{i+\Pi}$ and $\theta_4$ equals $\theta_{i+3\Pi/4}$) to achieve a zero average rotation rate velocity for point 25 polished on wafer 22 with respect to polishing surface 24 upon completion of a total polishing time $t_p$.

Figure 12:
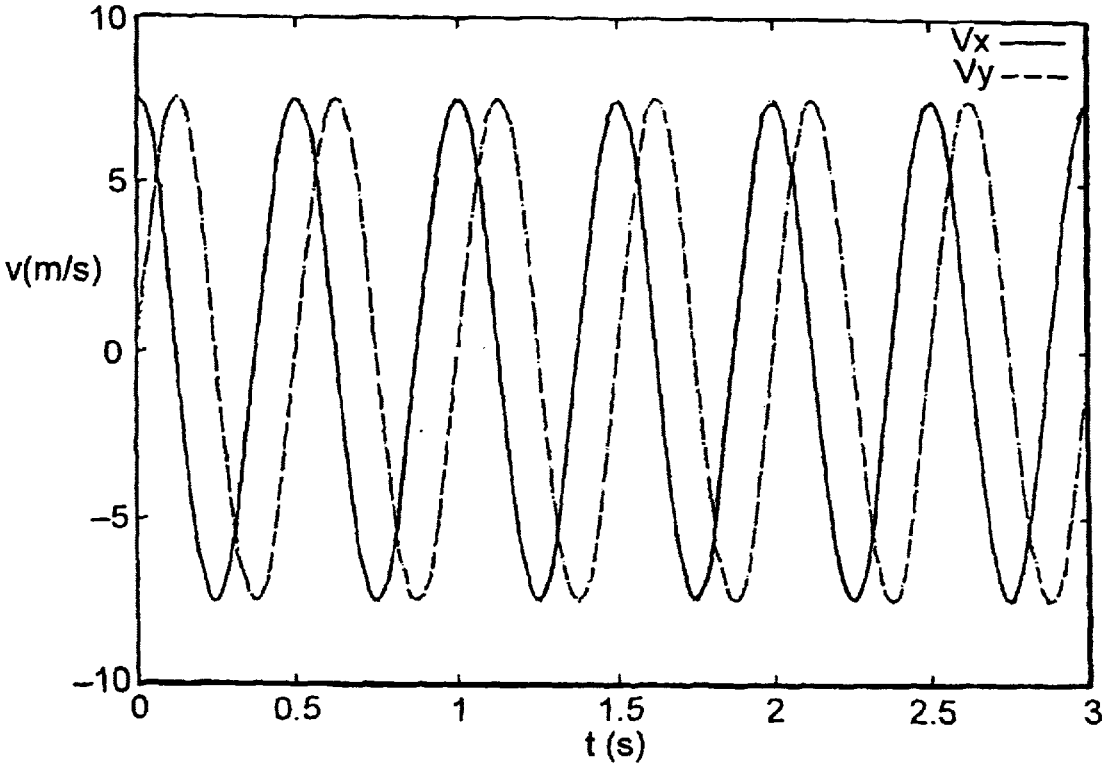
FIG. 12 graphs the sums $V_x$ and $V_y$ of the instantaneous velocity components $V_{x1\text{-}4}$ and $V_{y1\text{-}4}$ in FIG. 11.

Finally, FIG. 12 graphs the sum of velocity components $V_{x1-4}$ and $V_{y1-4}$, where $V_x$ equals the sum of $V_{x1-4}$ and $V_y$ equals the sum of $V_{y1-4}$. Together, FIG. 11 and FIG. 12 show a zero average rotation rate velocity may be achieved by controlling the rotation of wafer 22 based on adjustment angles $\theta_a$ (e.g., $\theta_2$, $\theta_3$ and $\theta_4$) with respect to surface 24.

A number of embodiments of the invention have been described. Nevertheless, it will be understood that various modifications may be made without departing from the spirit and scope of the invention. For example, the processes 50, 80 and 90 may be carried out in steps on different machines or on a single apparatus. The wafer rotation rate and/or off-matched rotation rate may be also adjusted in unequal intervals to produce a zero averaged rotation rate velocity during off-matched CMP. Furthermore, adjustment angles $\theta_a$ may be computed for any number of periods (p=2, 3, 4 . . .) desired by a manufacturer. Accordingly, other embodiments are within the scope of the following claims.

What is claimed is:

1. A chemical mechanical polishing process for polishing a semi-conductive wafer, comprising:

rotating a wafer having an alignment mark at a wafer rotation rate and a polishing surface at an off-matched rotation rate, wherein the wafer rotation rate and the off-matched rotation rate are not equal;

touching the wafer rotating at the wafer rotation rate and the polishing surface rotating at the off-matched rotation rate to polish a plurality of points on the wafer; and adjusting the wafer rotation rate and the off-matched rotation rate to achieve an approximately zero averaged rotation rate velocity for each of the plurality of points on the wafer with respect to the polishing surface polishing the wafer upon a completion of the total polishing time.

2. The process of claim 1, wherein adjusting comprises reversing the rotation of the wafer to an opposite but approximately equal adjusted wafer rotation rate and the polishing surface to an opposite but approximately equal adjusted off-matched rotation rate.

3. The process of claim 2, wherein the polishing surface includes a plurality of pads, wherein a first pad rotates at the off-matched rotation rate and a second pad rotates at the opposite but approximately equal adjusted off-matched rotation rate.

4. The process of claim 1, wherein the wafer rotates in a same direction as the polishing surface to polish the plurality of points on the wafer.

5. The process of claim 1, wherein the wafer rotates in an opposite direction from the polishing surface to polish the plurality of points on the wafer.

6. The process of claim 1, further comprising:

separating the wafer from the polishing surface to adjust the wafer rotation rate and the off-matched rotation rate upon completion of a portion of the total polishing time; and touching the wafer rotating at the adjusted wafer rotation rate and the polishing surface rotating at the adjusted off-matched rotation rate to polish the plurality of points on the wafer.

7. The process of claim 6, wherein touching occurs for approximately half of the total polishing time at the adjusted rotation rates.

8. The process of claim 6, wherein separating and touching the wafer and the polishing surface at the adjusted rates occur a plurality of times to polish the plurality of points on the wafer.

9. The process of claim 1, wherein the wafer and polishing surface touch each other as the wafer rotation rate and the off-matched rotation rate are adjusted.

10. The process of claim 9, wherein the wafer rotation rate and the off-matched rotation rate are adjusted continuously to achieve the approximately zero averaged rotation rate velocity for each of the plurality of points on the wafer.

11. A chemical mechanical polishing process for polishing a semi-conductive wafer, comprising:

rotating a wafer having an alignment mark at a wafer rotation rate using a wafer carrier to hold and rotate the wafer;

rotating a polishing pad at an off-matched rotation rate, wherein the wafer rotation rate and the off-matched rotation rate are not equal;

touching the wafer rotating at the wafer rotation rate and the first polishing pad rotating at the off-matched rotation rate to polish a plurality of points on the wafer for a portion of a total polishing time;

separating the wafer and the first polishing pad;

adjusting the wafer rotation rate to an adjusted wafer rotation rate;

adjusting the off-matched rotation rate to an adjusted off-matched rotation rate; and touching the wafer rotating at the adjusted wafer rotation rate and the polishing pad rotating at the adjusted off-matched rotation rate to polish the plurality of points on the wafer for a remainder of the total polishing time to achieve an approximately zero averaged rotation rate velocity for each of the plurality of points on the wafer with respect to the rotation of a polishing surface defined by the rotation of the first polishing pad and the second polishing pad polishing the plurality of points on the wafer.

12. The process of claim 11, wherein adjusting includes providing a second wafer carrier to hold and rotate the wafer at the adjusted wafer rotation rate.

13. The process of claim 11, wherein the wafer is polished for approximately half of the total polishing time at the adjusted wafer rotation rate and the adjusted off-matched rotation rate.

14. The process of claim 13, wherein the adjusted wafer rotation rate is approximately equal to but opposite in rotation from the wafer rotation rate and the adjusted off-matched rotation rate is approximately equal to but opposite in rotation from the off-matched rotation rate.

15. A chemical mechanical polishing process for polishing a semi-conductive wafer, comprising:

rotating a wafer having an alignment mark at a wafer rotation rate and a polishing surface at an off-matched rotation rate, wherein the wafer rotation rate and the off-matched rotation rate are not equal;

touching the wafer rotating at the wafer rotation rate and the polishing surface rotating at the offmatched rotation rate at an initial angle $\theta_i$ with respect to the polishing surface to polish a plurality of points on the wafer for a portion of a total polishing time; and adjusting the position of the wafer rotating at the wafer rotation rate with respect to the polishing surface rotating at the off-matched rotation rate to achieve an approximately zero averaged rotation rate velocity for each of the plurality of points on the wafer with respect to the polishing surface polishing the wafer upon a completion of the total polishing time.

16. The process of claim 15, further comprising:

dividing the total polishing time into a plurality of periods;

separating the wafer from the polishing surface upon completion of each period and adjusting the position of the wafer with respect to the polishing surface by an adjustment angle $\theta_a$ for each remaining period; and touching the adjusted wafer rotating at the wafer rotation rate to the polishing surface rotating at the off-matched rotation rate for each remaining period of the polishing time to polish the plurality of points on the wafer.

17. The process of claim 16, wherein the plurality of periods are each approximately equal time portions of the total polishing time and the adjustment angle $\theta_a$ is based upon dividing a rotation of the wafer by a number for the plurality of periods.

18. The process of claim 16, wherein the total time portion is divided into two approximately equal portions and the adjustment angle $\theta_a$ rotates the wafer by approximately half of a rotation for the touching of the adjusted wafer to the polishing pad.

19. The process of claim 16, wherein the total time portion is divided into four approximately equal portions and the adjustment angle rotates the wafer by approximately one quarter of a rotation of the wafer for each touching of the adjusted wafer to the polishing pad.

* * * * *